United States Patent [19]

Ishii et al.

[11] Patent Number: 4,908,261

[45] Date of Patent: Mar. 13, 1990

[54] NON-FERROUS METAL MECHANICAL PART

[75] Inventors: Takashi Ishii, Tokyo; Hisao Yabe, Fujisawa; Hajime Kohama, Yokohama, all of Japan

[73] Assignee: Kabushiki Kaisha Toshiba, Kawasaki, Japan

[21] Appl. No.: 252,001

[22] Filed: Sep. 30, 1988

Related U.S. Application Data

[63] Continuation of Ser. No. 31,262, Mar. 30, 1987, abandoned.

[30] Foreign Application Priority Data

Mar. 31, 1986 [JP] Japan ..... 61-72838
Mar. 31, 1986 [JP] Japan ..... 61-72839

[51] Int. Cl.[4] ..... B32B 9/00; C23F 7/26; C23C 1/12

[52] U.S. Cl. ..... 428/216; 428/469; 428/702; 148/264

[58] Field of Search ..... 428/216, 469, 702

[56] References Cited

U.S. PATENT DOCUMENTS 3,873,344 3/1975 Church et al. ..... 117/62
4,563,397 1/1986 Ishiguro et al. ..... 428/469

FOREIGN PATENT DOCUMENTS 504620 4/1959 United Kingdom .
926402 5/1963 United Kingdom .
1234181 6/1971 United Kingdom .
1329198 9/1973 United Kingdom .
1419288 12/1975 United Kingdom .
1478979 7/1977 United Kingdom .
2063308 6/1981 United Kingdom .
2071162 9/1981 United Kingdom .
2162365 1/1986 United Kingdom .
WO84/01954 5/1984 World Int. Prop. O. .

*Primary Examiner*—P. C. Ives
*Attorney, Agent, or Firm*—Oblon, Spivak, McClelland, Maier & Neustadt

[57] ABSTRACT

A non-ferrous metal mechanical part having a wear-resistant and smooth surface, and comprising a substrate of a metal selected from the group consisting of aluminum, aluminum alloy, nickel, and nickel alloy, and a surface layer formed on a surface of said substrate and containing chromium oxide ($Cr_2O_3$) as a major constituent. The chromium oxide ($Cr_2O_3$) is a substance which has been converted by heating a chromium compound, and an intermediate layer containing a reaction product between the substrate and chromium oxide in the surface layer is formed at an interface between the surface layer and the substrate.

11 Claims, 1 Drawing Sheet

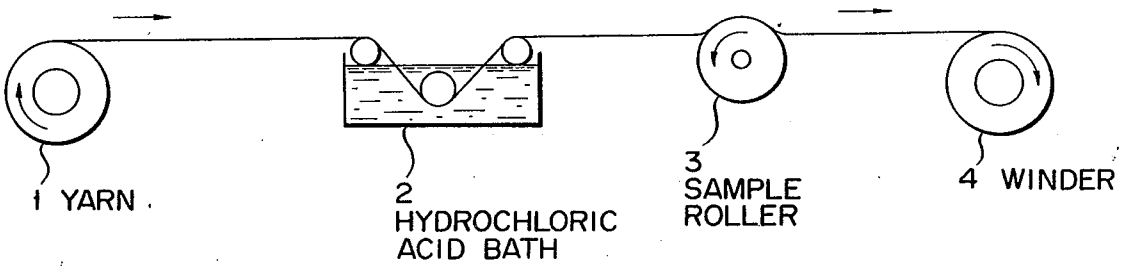
1 YARN
2 HYDROCHLORIC ACID BATH
3 SAMPLE ROLLER
4 WINDER

NON-FERROUS METAL MECHANICAL PART

This application is a Continuation of application Ser. No. 07/031,262 filed on Mar. 30, 1987, now abandoned.

BACKGROUND OF THE INVENTION

I. Field of the Invention

The present invention relates to a mechanical part having a wear-resistant surface and cosisting of a non-ferrous metal.

II. Description of the Prior Art

Aluminum is light in weight, has a good corrosion resistance in, air and high electrical and thermal conductivities, and can be easily machined. An aluminum alloy is obtained by adding various elements to aluminum, so as to improve its characteristics for application in various fields. Aluminum and aluminum alloy having the above characteristics are widely used as a material for chemical industry devices, electrical instruments, optical instruments, sanitary vessels, buildings, ships, vehicles, household articles, and the like.

On the other hand, nickel is superior both in heat resistance and corrosion resistance, and hence is used as a material, in the form of a plate or a bar, by food industries, chemical industries, electrical instruments, and the like. A nickel alloy is obtained by adding various elements to nickel, so as to improve its characteristics, and is used as a heat-resistant material, a corrosion-resistant material, and a magnetic material.

Aluminum, aluminum alloy, nickel, and nickel alloy are also widely used respectively as a material for a mechanical part such as a roller which is brought into contact with running paper, a plastic film, a fibrous member, and the like, and for a mechanical part such as a bearing part or a sliding part which is brought into contact with another mechanical part. In these cases, in order to prevent wear on the surface and to improve its sliding property in relation to another part, superior wear resistance and superior surface smoothness are required. Such a mechanical part which produces friction between itself and another member must be made of a material selected in accordance with its required characteristic, and must be able to maintain this characteristic at high level.

In addition, aluminum and aluminum alloy are widely used in chemical plants, and nickel and nickel alloy are widely used as a shaft or an impeller of a pump. However, these parts are mainly used in a corrosive atmosphere such as watr, acid, or alkali, and hence require good corrosion resistance. A part used in such a corrosive atmosphere must be made of properly selected material which has and is able to maintain a high level of corrosion resistance.

In recent years, attempts have been made to form a surface layer which is different from a substrate, on the surface of parts, so as to endow parts consisting of aluminum, aluminum alloy, nickel, or nickel alloy, in with the characteristics required according to conditions of use or environmental factors, addition to their original characteristics. Such a surface layer must have satisfactory wear resistance to friction produced in association with other parts, as well as a high degree of smoothness for improving its sliding properties in relation to other parts, must not damage other parts, and must have a sufficiently high resistance to chemicals, so as not to become corroded in a corrosive environment. Furthermore, the surface layer formed on the substrate surface of the parts must have high mechanical strength, must not degrade the characteristics of the substrate upon formation, and require no finishing such as grinding after formation.

Known methods for forming a surface layer on a substrate surface of parts consisting of aluminum, aluminum alloy, nickel, or nickel alloy plating, are PVD (physical vapor deposition), CVD (chemical vapor deposition), frame spraying, and the like. However, these methods cannot always satisfy all the above-mentioned requirements, and practical application is not easily accomplished. More specifically, surface layers formed by these methods have insufficient density, wear-resistance, and smoothness. The bonding strength between the surface layer and the substrate is also insufficient, and the surface layer often peels away from the substrate. In addition, a finishing process is required after the formation of the surface layer.

SUMMARY OF THE INVENTION

The present invention has been developed in consideration of the above situation, and has as its object to provide a mechanical part having a surface layer which has superior wear resistance, smoothness, and resistance to chemicals, and can be easily formed on a substrate, with high mechanical strength, but without degrading the characteristics of the substrate.

According to the present invention, there is provided a non-ferrous metal mechanical part comprising a substrate of a metal selected from the group consisting of aluminum, aluminum alloy, nickel, and nickel alloy, and a surface layer formed on a surface of said substrate, and containing chromium oxide ($Cr_2O_3$) as a major constituent. The chromium oxide ($Cr_2O_3$) is a material converted by heating a chromium compound, and an intermediate layer containing a reaction product between the substrate and chromium oxide in the surface layer is formed at an interface between the surface layer and the substrate.

In the present invention, any aluminum alloy may be used as a substrate. For example, a casting aluminum alloy such as an Al-Cu based alloy or Al-Si based alloy; a corrosion-resistant Al alloy such as an Al-Mn based alloy; and a high-strength Al alloy such as an Al-Cu-Mg-Mn based alloy may be used.

Similarly, any nickel alloy, for example, an Ni-Cu based alloy, Ni-Fe alloy, Ni-Cr based alloy, or Ni-Mo based alloy, may be used.

The material and shape of substrate are selected in accordance with the application of the mechanical part.

The mechanical part of the present invention includes various parts which are brought into contact with a member consisting of a fibrous member, paper, rubber, plastics, resin, ceramics, or metal. Such a mechanical part includes parts such as bearing or sliding parts of a machine, e.g., weaving machine parts, or a cylinder in engine parts, or pump parts. A weftlength measuring drum of a super automatic loom is an example of weaving machine parts. In addition, the mechanical part of the present invention can preferably apply to parts used in a corrosive atmosphere, such as chemical machine parts, a centrifugal winder funnel corner of a chemical fiber device, and the like, and can be most preferably apply to a roller and the like which slides with, for example, a fibrous member, paper, a plastic tape and the like, at high speed.

The surface layer formed on the substrate of the mechanical parts according to the present invention has a dense structure of chromium oxide ($Cr_2O_3$) particles converted from a chromium compound upon heating, and firmly bonded to each other. The surface layer is smooth and has a good wear-resistance property. Since the size of the precipitated $Cr_2O_3$ ceramic particles is very small (1 μm or less), the surface layer can be a dense, smooth layer substantially without pores, and can be formed to be very thin. Therefore, the inherent characteristics (e.g., elasticity) of the substrate can be utilized effectively. The hardness of the surface layer is a high as a Vicker's hardness (HV) of 500 or more. The intermediate layer, as a reaction product between the material and chromium oxide, is formed at the interface between the surface layer and the substrate. The surface layer can be formed, on the substrate, with a high adhesion strength (500 kgf/cm$^2$). The thickness of the intermediate layer falls within the range of 0.5 to 3.0 μm. The surface layer also has a high resistance to corrosion, a property for eliminating foreign materials, and high resistance to chemicals.

Chromium oxide ($Cr_2O_3$) contained in the surface layer serves to increase the hardness and decrease the friction coefficient thereof.

Mechanical parts with such a surface layer are manufactured by the following method:

A chromium compound solution such as aqueous solution of $CrO_3$ is applied to the surface of the substrate, by means of coating or dipping. The substrate to which the $CrO_3$ solution has been applied is baked at a temperature of 500° to 600° C. (preferably about 550° C.) in a reaction treatment, whereby a layer containing $Cr_2O_3$ as a major constituent is formed on a substrate surface region. A baking temperature of 500° to 600° C. allows the conversion of $CrO_3$ to $Cr_2O$. A cycle of $CrO_3$ application and baking is repeated a plurality of times, to form a dense, hard ceramic coating layer containing $Cr_2O_3$ on the surface of the substrate. The thickness of this layer is 1 to 50 μm. In this manner, the thickness is controlled by the number of cycles repeated as above. The thickness of the surface layer of the mechanical parts is preferably 1 to 10 μm, and more preferably, 2 to 6 μm. Since the baking temperature falls within the range of 500° to 600° C., the characteristics of the substrate are not degraded.

Any chromium compound, including $CrO_3$, to be converted to $Cr_2O_3$ by heating, can be used. Examples of such a chromium compound are $NaCrO_4.10\ H_2O$, $Na_2Cr_2O_7.2\ H_2O$, $K_2CrO_4$, $K_2Cr_2O_7$, and $(NH_4)_2Cr_2O_7$. In addition, the solution is not limited to an aqueous solution, but can be substituted by a molten salt. The concentration level of the solution is preferably 10 to 85%.

BRIEF DESCRIPTION OF THE DRAWING

The FIGURE is a schematic view showing the procedures of a corrosion resistance test adopted in Example 1.

DETAILED DESCRIPTION OF THE PREFERRED EMBODIMENT

Examples of the present invention will now be described below.

An Al-Mn based alloy (Nn: 1.0~1.5%, Si: 0.6% or less, Fe: 0.7% or less, Zn: 0.10% or less, Al balance) was used as a substrate, and 4 test samples, i.e., test samples having surface layers according to the present invention (samples No. 1 and 2), and test samples having surface layers obtained by a conventional method (samples No. 3 and 4), were prepared, as is shown in Table 1 below.

Sample No. 1 was prepared as follows:

The outer surface of a disk-like test sample having an outer diameter of 100 mm× a thickness of 30 mm was coated with a prepared slurry consisting of [$CrO_3$+($Al_2O_3$+$ZrO_2$+$SiO_2$+ZnO)+$H_2O$], by means of dipping. After the resultant material was dried, it was baked in air at a temperature of 450° C. to 500° C., to form a porous layer consisting of a reaction product ($Al_2O_3.Cr_2O_3$) of the substrate material with $Cr_2O_3$, $Cr_2O_3$, and various ceramics added thereto. Then, the porous layer was dipped into an aqueous solution of $H_2CrO_4$. After the resultant material was dried, it was baked in air at a temperature of 450° C. to 500° C. This dipping process was repeated about 12 times, whereby a dense surface layer having at thickness about 40 μm was formed on the surface of the test sample. This surface layer is a ceramic coating consisting of $Cr_2O_3$+$Al_2O_3$+$ZrO_2$+$SiO_2$.

Sample No. 2 was prepared in the following way:

A test sample having the dimensions as described above mentioned was dipped into an aqueous solution of $H_2CrO_4$ (chromic acid) for one or two minutes. After the resultant material was dried, it was baked in air at a temperature of 450° C. to 500° C. This process was repeated about 10 times, whereby a surface layer having a thickness of about 5 μm formed on a surface of the test sample. This surface layer is a ceramic coating consisting of a reaction product layer of Al with $CrO_3$, and $Cr_2O_3$.

TABLE 1

| Test Sample No. | Method of Forming Surface Layer | Surface Layer Material | Thickness of Surface Layer (μm) | Hardness of Surface Layer (Hv) | Substrate Material |
|---|---|---|---|---|---|
| 1 | Present invention | $Cr_2O_3$ + ceramic powder | 20~50 | 1300<br>1500 | A Mn based alloy |
| 2 | Present invention | $Cr_2O_3$ | 3~5 | 500<br>600 | " |
| 3 | Plasma frame spraying | $Cr_2O_3$ | 100~150 | 900 | " |
| 4 | Plating | Cr | 10 | 700 | " |

A test was then performed to examine wear resistance, as well as the corrosion resistance of these test samples. A test method and test results will be described below. The test was performed by a method shown in the figure, under the following conditions:

A yarn (polyester: 50 d/48 F) serving as a test sample was dipped into a dilute hydrochloric acid solution, and then wound up through a roller. The results of this test are shown in Table 2. It is apparent from the test results that the roller test sample according to the present invention possesses excellent wear resistance with respect to the yarn and corrosion resistance. (Especially, in samples No. 3 and No. 4, the yarn broke, and when it was woven into a cloth, unevenness occurred).

| Test conditions: | |
|---|---|
| Rotation Speed of Test Sample | 1,000 rpm |
| Concentration of Solution | Hydrochloric Acid Ions Were Present |
| Winding Speed | 0.5 m/min |
| Test Time | 500 hr |
| Test Results | |

TABLE 2

| Test Sample No. | Method of Forming Surface Layer | Degree of Wear Damage | Degree of Corrosion Damage |
|---|---|---|---|
| 1 | Present invention | No wear mark | No corrosion mark |
| 2 | Present invention | No wear mark | No corrosion mark |
| 3 | Plasma frame spraying | No wear mark | X Partly peeling off |
| 4 | Plating | X Large wear mark | X rougle surface |

EXAMPLE 2

Ni—Fe based alloy (N: 79%, Mo: 4%, Cr: 0.7%, Fe: balance) and Ni—Cr based alloy (Ni: 58~63%, Cr: 21~25%, Fe: balance) were used as substrates, and eight test samples including one having no surface layer, one having a surface layer according to the present invention, and one having a surface layer according to a conventional method were prepared, as is shown in Table 3 below.

TABLE 3

| Test Sample No. | Method of forming Surface Layer | Surface Layer Material | Thickness of Surface Layer (μm) | Hardness of Surface Layer (Hv) | Substrate Material |
|---|---|---|---|---|---|
| 5 | No surface layer | — | — | 300 400 | Ni—Fe based alloy |
| 6 | No surface layer | — | — | 350 500 | Ni—Cr based alloy |
| 7 | Present invention | $Cr_2O_3$ | 4 to 5 | 600 700 | Ni—Fe based alloy |
| 8 | Present invention | $Cr_2O_3$ | 4 to 5 | 800 900 | Ni—Cr based alloy |
| 9 | PVD | TiC | 2 to 3 | 2,000 | Ni—Fe based alloy |
| 10 | PVD | TiC | 2 to 3 | 2,000 | Ni—Cr based alloy |
| 11 | CVD | TiN | 6 to 7 | 3,000 | Ni—Fe based alloy |
| 12 | CVD | TiN | 6 to 7 | 3,000 | Ni—Cr based alloy |

A finishing process was performed for the substrate surfaces of test samples No. 5 and No. 6, no finishing process being performed for test samples No. 7 and No. 8, after formation of the surface layers. Test samples No. 9 to No. 12 were subjected to a finishing process, after formation of the surface layers.

As for test samples No. 7 and No. 8, the surface layer was formed on the substrate surface as follows:

A substrate was dipped in a 50% aqueous solution of chromic acid ($CrO_3$) for 1 to 2 minutes. After the substrate was dried, it was baked in air at a temperature of 500° to 600° C. The aforementioned processes was repeated 16 times, whereby a 5-μm thick surface layer was formed on the substrate surface. The surface layer was constituted by an intermediate layer containing a reaction product ($NiO.Cr_2O_3$) of the substrate and $CrO_3$, and $Cr_2O_3$as a major constituent, and a layer containing $Cr_2O_3$, converted from $CrO_3$, as a major constituent.

These test samples were tested in order to examine their wear-resistance and resistance to chemicals.

Wear-Resistance Test

The wear-resistance was verified by means of a high-speed fiber sliding test. The test conditions were as follows:

| | |
|---|---|
| Fiber | Polyester 50d/48f |
| Speed | 3.5 m/sec |
| Tension | 65 g |
| Test Time | 24 hr |

Table 4 shows the test results.

TABLE 4

| Test Sample No. | Method of Forming Surface Layer | Surface Layer Material | Degree and State of Damage |
|---|---|---|---|
| 5 | No surface layer | — | X Large wear mark: No breakage of yarn for 24 hr |
| 7 | Present invention | $Cr_2O_3$ | No wear mark: No breakage of yarn for 24 hr |
| 9 | PVD | TiC | Δ Small wear mark: Yarn broke after 20 hr |
| 11 | CVD | TiN | Δ Medium wear mark: Yarn broke after 12 hr |

As can be understood from Table 4, the test sample of the present invention had no wear mark and no breakage of yarn after a 24-hr travel of yarn.

Corrosion-Resistance Test

The corrosion-resistance of the test sample was tested such that a decrease in weight of the samples by dipping them into an aqueous solution of hydrochloric acid was measured. The test conditions were as follows:

| | |
|---|---|
| Concentration of Solution | 5%, 10% |

-continued

| | |
|---|---|
| Temperature | Ambient Temperature |
| Dipping Time | 24 hr |

Table 5 shows the test results.

TABLE 5

| Test Sample No. | Method of forming Surface Layer | Concentration of Hydrochloric Acid 5% | 10% |
|---|---|---|---|
| 5 | No surface layer | 0.72 mg/cm$^2$ | 2.5 mg/cm$^2$ |
| 7 | Present invention | 0 | 0.1 mg/cm$^2$ |

As can be understood from Table 5, the test sample of the present invention showed excellent corrosion resistance.

According to the present invention as described above, a mechanical part having a surface layer which has superior wear resistance, smoothness, and resistance to chemicals, and can be easily formed on a substrate with high mechanical strength, but without impairing the characteristics of the substrate.

What is claimed is:

1. A non-ferrous metal mechanical part having a wear-resistant surface comprising:

(a) a substrate of a metal selected from the group consisting of aluminum, aluminum alloy, nickel and nickel alloy;

(b) a substantially non-porous surface layer formed on a surface of said substrate, said surface layer substantially containing chromium oxide, said chromium oxide being converted from a chromium compound capable of forming the same upon heating thereof; and (c) an intermediate layer including a reaction product between the chromium oxide in said surface layer and said substrate, being formed at an interface between said surface layer and said substrate;

which mechanical part is produced by a process which comprises:

(1) applying an aqueous solution of a chromium compound capable of forming chromium oxide upon heating to the surface of a substrate of a metal selected from the group consisting of aluminum, aluminum alloy, nickel and nickel alloy, to form a coated substrate; and (2) heating said coated substrate to a temperature of about 450° to 600° C., thereby converting said chromium compound in said applied aqueous solution to chromium oxide, to form a dense, hard wear-resistant ceramic layer on said substrate.

2. The mechanical part according to claim 1, wherein said surface layer has a thickness of 1 to 50 μm.

3. The mechanical part according to claim 1, wherein said surface layer has a thickness of 1 to 10 μm.

4. The mechanical part according to claim 1, wherein said surface layer has a thickness of 2 to 6 μm.

5. The mechanical part according to claim 1, wherein the chromium compound is $CrO_3$.

6. The mechanical part according to claim 1, wherein said intermediate layer has a thickness of 0.5 to 3.0 μm.

7. The mechanical part according to claim 1, wherein said substrate comprises aluminum or aluminum alloy, and said intermediate layer comprises $Al_2O_3.Cr_2O_3$ and $Cr_2O_3$.

8. The mechanical part according to claim 1, wherein said substrate comprises nickel or nickel alloy, and said intermediate layer comprises $NiO/Cr_2O_3$ and $Cr_2O_3$.

9. The mechanical part according to claim 1, wherein said surface layer contains chromium oxide having a particle size of 1 μm or less.

10. The mechanical part according to claim 1, wherein said surface layer has a Vicker's hardness of at least 500.

11. The part according to claim 1, wherein said chromium compound capable of forming chromium oxide upon heating is selected from the group consisting of $CrO_3$, $NaCrO_4.10\ H_2O$, $Na_2Cr_2O_7.2\ H_2O$, $K_2CrO_4$, $K_2Cr_2O_7$ and $(NH_4)_2Cr_2O_7$.

* * * * *